US009206362B2

(12) United States Patent
Haizmann et al.

(10) Patent No.: US 9,206,362 B2
(45) Date of Patent: Dec. 8, 2015

(54) CATALYTIC REFORMING PROCESS WITH DUAL REFORMING ZONES AND SPLIT FEED

(71) Applicant: UOP LLC, Des Plaines, IL (US)

(72) Inventors: Robert S. Haizmann, Rolling Meadows, IL (US); Bryan K. Glover, Angonquin, IL (US)

(73) Assignee: UOP LLC, Des Plaines, IL (US)

( * ) Notice: Subject to any disclaimer, the term of this patent is extended or adjusted under 35 U.S.C. 154(b) by 256 days.

(21) Appl. No.: 13/924,925

(22) Filed: Jun. 24, 2013

(65) Prior Publication Data

US 2014/0374313 A1 Dec. 25, 2014

(51) Int. Cl.
*C10G 57/00* (2006.01)
*C10G 59/00* (2006.01)

(52) U.S. Cl.
CPC ..... *C10G 59/00* (2013.01); *C10G 2400/30* (2013.01)

(58) Field of Classification Search
CPC ..... C10G 59/00; C10G 2400/30
USPC ..... 208/51, 64
See application file for complete search history.

(56) References Cited

U.S. PATENT DOCUMENTS

| | | | | |
|---|---|---|---|---|
| 3,647,679 | A * | 3/1972 | Kirk et al. | 208/64 |
| 4,202,758 | A | 5/1980 | O'Hara | |
| 5,366,614 | A * | 11/1994 | Russ et al. | 208/65 |
| 5,382,350 | A | 1/1995 | Schmidt | |
| 5,683,573 | A | 11/1997 | Haizmann | |
| 5,935,415 | A | 8/1999 | Haizmann | |
| 6,177,002 | B1 * | 1/2001 | Glover | 208/64 |

* cited by examiner

*Primary Examiner* — Randy Boyer
*Assistant Examiner* — Juan Valencia

(57) ABSTRACT

A process for the conversion of paraffins and olefins in a hydrocarbon feedstream to aromatics is presented. The process includes separating the hydrocarbon feedstream into two separate streams, a lighter hydrocarbon stream and a heavier hydrocarbon stream, and processing each of the streams separately. The process includes passing the light stream through a series of reforming units and adding the heavy stream at a downstream position to pass through a subsequent reforming unit.

20 Claims, 1 Drawing Sheet

CATALYTIC REFORMING PROCESS WITH DUAL REFORMING ZONES AND SPLIT FEED

FIELD OF THE INVENTION

The present invention relates to a process for the conversion of hydrocarbons to aromatic compounds. In particular, the conversion to aromatics of naphtha range hydrocarbons.

BACKGROUND OF THE INVENTION

The upgrading of hydrocarbon streams to more valuable products has included catalytic reforming processes. A particular hydrocarbon stream is the naphtha stream, which usually includes substantially large concentrations of naphthenic and chain paraffinic compounds in the C5 to C12 range. Naphtha is a primary feedstock for gasoline, bit is also a feedstock for the production of light olefins through catalytic cracking, and for the production of aromatic compounds used as precursors for polymers, detergents, or for upgrading motor fuels, such as diesel.

The reforming process performs a variety of concomitant reactions which consists principally of naphthene isomerization, dehydrogenation of naphthenes to aromatics, dealkylation and demethylation of aromatics to lighter aromatics, isomerization of normal paraffins to isoparaffins, and hydrocracking. Reforming is a catalytic process that relies on a substantial number of acid and metal sites on the catalyst. A typical reforming process mixes hydrogen with the hydrocarbon feedstock before entering a first reaction zone. The feed passes serially through at least one additional reaction zone before separation to provide a vapor phase comprising hydrogen for recycle of the feedstock and a liquid product phase providing the gasoline composition. Since the various reactions that take place are highly endothermic, the process takes place in a series of reaction zones with intermediate reheating between the reaction zones to maintain reaction temperatures. It has been taught that the reforming process can operate at a wide variety of conditions including temperatures in a range of from 420 to 540 C, pressures of from 100 to 7000 kPa (absolute), liquid hourly space velocities (LHSV) of from 0.1 to 10, and hydrogen to hydrocarbon ratios of from 0.5 to 20.

The effectiveness of reforming has generally relied on improvements in the catalysts. Reforming catalysts typically comprise dual functional catalysts that perform a dehydrogenation function and a cyclization function. However, the complex chemistry around reforming can lead to improved processes wherein the chemistry is further controlled by new process steps.

SUMMARY OF THE INVENTION

The present invention provides a process for improving the control of the yields of products from a catalytic reforming process. This enables the redirection of a process stream to shift product distributions of intermediate products for downstream processing, and in particular the increasing of the aromatics content of a feedstream to an aromatics complex. The invention for increasing the aromatics content from reforming a naphtha feedstream. The naphtha feedstream is passed to a separation unit to generate a light stream comprising C5− hydrocarbons, an intermediate stream, and a heavy stream. The light stream is passed to other processing units.

The intermediate stream is heated and passed to a first reforming unit, to generate a first effluent stream. The first effluent stream heated and is passed to a second reforming unit to generate a second effluent stream. The first reforming unit includes a first catalyst and is operated at a first set of reaction conditions. The second reforming unit includes a second catalyst, which is different from the first catalyst, and is operated at a second set of reaction conditions. The second effluent stream is combined with the heavy stream to form a third process stream. The third process stream is heated and passed to a third reforming unit to generate an effluent stream having an increased C9 aromatics content. The third reforming unit includes a catalyst that is the same catalyst as the first reforming unit, and is operated at a third set of reaction conditions.

Other objects, advantages and applications of the present invention will become apparent to those skilled in the art from the following detailed description and drawings.

DETAILED DESCRIPTION OF THE INVENTION

An aromatics complex is an integral part of a refinery operation. The aromatics complex is designed for increasing the yields of aromatics to be used in downstream processing. Two aromatics of interest are benzene and xylenes, and in particular benzene and para-xylene, or p-xylene. A typical aromatics complex includes a reforming unit for converting a naphtha feed to aromatics. The yields are typically 65 wt % or less based on the naphtha feed. Increasing the yields increases the return on investment, and decreases the amount of lower value products generated.

Aromatics are useful for a number of products, and increasing the yields of aromatics leads to improved economics of refineries. However, the normal process for increasing aromatics yields leads to increased C6 to C8 aromatics while sacrificing the yields of C9+ aromatics. In the production of diesel fuel, the yields of C9+ aromatics, and in particular cumene, or isopropyl benzene, is desired.

Figure 1:
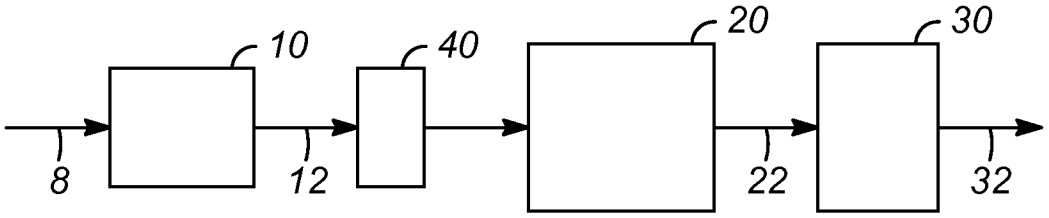
FIG. 1 is a hybrid reforming configuration.

One method of improving the reforming of a naphtha stream involves utilizing different catalysts. As shown in FIG. 1, the reforming process involves passing a hydrocarbon feedstream 8 to a first reforming unit 10 to generate a first effluent stream 12 comprising aromatics. The first reforming unit 10 can comprise multiple catalyst beds having a first type of reforming catalyst, and is operated under a first set of reaction conditions. The first effluent stream 12 is passed to a second reforming unit 20 to generate a second effluent stream 22, having an increased aromatics content over the first effluent stream. The second reforming unit 20 can comprise multiple catalyst beds having a second type of reforming catalyst, and is operated under a second set of reaction conditions. The second effluent stream 22 is passed to third reforming unit 30 to generate a third effluent stream 32 having an increased aromatics content over the second effluent stream 22. The third reforming unit 30 can comprise multiple catalyst beds having a third type of reforming catalyst, and is operated under a third set of reaction conditions. In this process configuration, the third reforming unit 30 utilizes a catalyst that is the same as the first reforming unit, and is operated under the first set of reforming conditions. This process control utilizes the case where some hydrocarbons in the feedstream are more readily converted with a different catalyst.

This is called hybrid reforming, where the process combines a dual functional reforming, i.e. CCR Platforming, with a platinum L-zeolite reforming. The dual functional reforming catalyst is the first catalyst, and the platinum L-zeolite catalyst is the second catalyst. This approach increases aromatics over conventional CCR Platforming. However, hybrid reforming can reduce the production of heavier aromatics, for example C9+ aromatics, or A9+. The platinum L-zeolite reforming, while generating increased aromatics, also causes high demethylation of aromatics. Also the platinum L-zeolite reforming has an increased deactivation rate with C9+ content in the feed. The platinum L-zeolite catalyst is also more sensitive to sulfur poisons, and a guard bed 40 is used for the feed to the second reaction unit 20.

Figure 2:
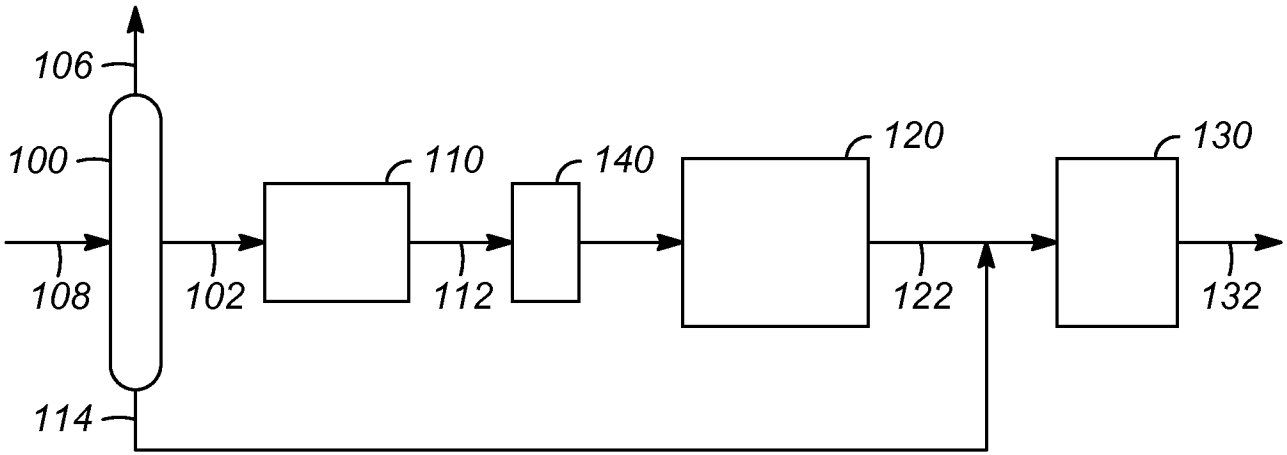
FIG. 2 is a hybrid reforming configuration with a split naphtha feed.

An improvement in this process involves splitting a naphtha feedstream to generate two or more streams having different compositions. The different streams are then passed to different reforming units to process the hydrocarbons. In one embodiment, the process is shown as in FIG. 2. The process is for converting a naphtha feedstream made up of C6+ hydrocarbons. A naphtha feedstream typically includes C5 hydrocarbons and a small amount of lower hydrocarbons. The lighter hydrocarbons, C5−, are removed before processing the remainder of the naphtha feedstream. The process includes passing a naphtha feedstream 108 to a separation column 100 to generate a light overhead stream 106, an intermediate stream 102, and a heavy naphtha bottoms stream 104. The intermediate stream 112 is passed to a first reforming unit 110 to generate a first effluent stream 112. The first reforming unit 110 can include two or more reactor beds with interheaters between the reactor beds. The process can also include a charge heater to heat the feedstream to the first reactor bed. The first reactor unit 110 includes a first catalyst and is operated at a first set of reaction conditions. The light overhead stream 106 will include C5− hydrocarbons.

The first effluent stream 112 is passed to a second reforming unit 120 to generate a second effluent stream 122. The second reforming unit 120 can include two or more reactor beds with interheaters between the reactor beds. The second reforming unit 120 includes a second catalyst, that is different from the first catalyst, and is operated at a second set of reaction conditions. In one embodiment, the second reforming unit 120 includes a guard bed 140, where the feed 112 to the second reforming unit is passed to adsorb residual contaminants in the process stream. The second reforming effluent stream 122 is combined with the heavy naphtha stream 114 and passed to the third reforming unit 130, to generate a third effluent stream 132. The third reforming unit can include multiple reactor beds, has a third catalyst and is operated under a third set of reaction conditions.

In a preferred embodiment, the first and third reforming catalysts are the same catalyst. The first and third reforming units can comprise moving bed reactors where the catalyst flows from one reactor in a series to a subsequent reactor in the series. Fresh, regenerated catalyst is passed to the first reforming unit, to generate a first catalyst effluent stream. Within the first reforming unit, catalyst can pass from one reactor bed to a subsequent reactor bed in a series of reactor bed in the first reforming unit. The first catalyst effluent stream is passed to the third reforming unit to generate a spent catalyst stream. The spent catalyst stream leaving the third reforming unit is passed to a regeneration unit for regenerating the catalyst and passing the regenerated catalyst to the first reforming unit.

The second reforming unit can comprise one or more moving bed reactors in series. The second catalyst is passed through the moving beds of the second reforming unit to generate a second spent catalyst stream. The second spent catalyst stream is passed to a second regenerator to create a second regenerated catalyst stream, and to pass the regenerated second catalyst to the second reforming unit.

In one embodiment, the separation unit 100 generates an intermediate stream 102 comprising C6 to C8 hydrocarbons, and a heavy bottoms stream comprising C9+ hydrocarbons. The C6 to C8 intermediate stream is passed through all the reforming units to generate C6 to C8 aromatics. The heavy bottoms stream comprising C9+ hydrocarbons is passed to the third reforming unit 130. This generates an increase in the C9 and C10 aromatics over the process of passing the entire naphtha feedstream through all the reforming units.

In another embodiment, the process includes splitting the naphtha feed to different compositions. One splitting of the naphtha feed is to generate an intermediate stream comprising C6 hydrocarbons, and a heavy bottoms stream comprising C7+ hydrocarbons. The C6 intermediate stream is passed through the first 110 and second 120 reforming units to generate a process stream having an increased benzene content. The process stream is then combined with the heavy naphtha stream 114 and passed to the third reforming unit 130 to generate a reformed effluent stream 132.

In one embodiment, the second reforming unit 120 comprises fixed bed reactors. With fixed bed reactors, a plurality of reactors are used, where one is offline for regeneration, while one or more is online for processing.

TABLE 1

| Yield comparisons (percent) | | | |
|---|---|---|---|
| | CCR | Hybrid | Hybrid-split feed |
| A6 | 4.19 | 10.37 | 11.70 |
| A7 | 13.80 | 18.43 | 18.37 |
| A8 | 18.95 | 20.12 | 16.38 |
| A9 | 18.82 | 15.13 | 15.42 |
| A10 | 11.13 | 6.76 | 13.09 |
| A11+ | 0.06 | 0.12 | 0.17 |
| Total aromatics | 66.96 | 70.93 | 75.13 |

The process was operated at typical operating conditions of 450 kPa (absolute) (50 psig), and operated to obtain 85% conversion of C7 paraffins. The feed stream comprised a naphtha cut from C6 to 170° C.

The hybrid process improves the aromatics yield by about 4% by weight, but by splitting the feed and utilizing separate feeds to the different reforming units in the hybrid process, the aromatics yield was increase an additional 4+% by weight. In this particular comparison, the naphtha feed was split into an intermediate stream comprising C6 to C8 hydrocarbons, and the intermediate stream was fed to the dual function catalyst in the first reforming unit. The effluent from the first reforming unit was fed to the second reforming unit with a platinum L-zeolite catalyst. The heavy fraction comprises a stream of C9 to C11 hydrocarbons, and with the effluent from the second reforming unit, was passed to a third reforming unit that contain the dual function catalyst.

Bypassing the second reforming unit with the heavy naphtha produces a much higher yield of C9 to C11 aromatics. The C9 to C11 aromatics is fed to a transalkylation unit in an aromatics complex to increase the production of p-xylenes. In addition, a benefit for bypassing the second reforming unit with the heavy stream reduces the deactivation rate of the second reforming catalyst.

A typical configuration for this process includes two reactors for the first reforming unit, and a single reactor for the second reforming unit and a single reactor for the third reforming unit. The first and second catalyst are circulated and regenerated through separate regeneration units.

The separation unit can comprise a divided wall column to produce a side cut for the intermediate stream, or can comprise two separate columns to generate the different feedstreams.

More specifically, the present process uses a dual-function catalytic composite, as the first catalyst, which enables substantial improvements in those hydroprocesses that have traditionally used a dual-function catalyst. The particular catalytic composite of the present invention constitutes an alumina-zeolite support, a rare earth exchange metal component, at least one metal component from Group VIB or Group VIII and from about 0.1 to about 5 weight percent of at least one component from Group IIA based on the weight of the finished catalyst. Preferred compositions include a catalytic composite having a Group VIB component between 0.01% and 20% by weight, and a Group VIII component between 0.01% and 10% by weight. The alumina-zeolite weight ratio is preferably from 1:5 to 20:1, and a preferred zeolite is Y faujasite. The rare earth component of the catalytic composite is preferably between 1% and 10% by weight.

The second catalyst for use in the second reforming reaction unit is normally made of catalyst particles comprising of one or more Group VIII (IUPAC 8-10) noble metals (e.g., platinum, iridium, rhodium, palladium) and a halogen combined with a porous carrier, such as a refractory inorganic oxide. The catalyst may contain 0.05-2.0 wt % of Group VIII metal. The preferred noble metal is platinum. The halogen is normally chlorine. Alumina is a commonly used carrier. The preferred alumina materials are known as the gamma, eta and theta alumina with gamma and eta alumina giving the best results. An important property related to the performance of the catalyst is the surface area of the carrier. Preferably, the carrier will have a surface area of from 100 to about 500 $m^2/g$. The particles are usually spheroidal and have a diameter of from about 1/16th to about 1/8th inch (1.5-3.1 mm), though they may be as large as 1/4th inch (6.35 mm) In a particular regenerator, however, it is desirable to use catalyst particles which fall in a relatively narrow size range. A preferred catalyst particle diameter is 1/16th inch (3.1 mm) In the second reaction zone: a typical reaction zone inlet temperatures are from 450° C. to 549° C., and is operated at reaction pressures of from 440 to 1480 kPa (absolute).

While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. A process for converting a naphtha feedstream to aromatics, comprising:

passing the naphtha feedstream to a separation column, to generate a light overhead stream comprising C5− hydrocarbons, an intermediate stream comprising C6-C8 hydrocarbons, and a heavy naphtha bottoms stream comprising C8+ hydrocarbons;

passing the intermediate stream to first reforming unit, comprising a first catalyst, to generate a first reforming effluent stream;

passing the first reforming effluent to a second reforming unit, wherein the second reforming unit comprises a second catalyst, to generate a second reforming effluent stream; and passing the second reforming effluent stream and the heavy naphtha bottoms stream to a third reforming unit, wherein the third reforming unit comprises a third reforming catalyst, to generate a third reforming effluent stream.

2. The process of claim 1 further comprising operating the separation column to generate the intermediate stream comprises C6 hydrocarbons and the heavy stream comprises C7 normal and aromatic hydrocarbons and C8+ hydrocarbons.

3. The process of claim 1 wherein the intermediate stream comprises C6 to C8 hydrocarbons and the heavy stream comprises C9+ hydrocarbons.

4. The process of claim 1 wherein the first reforming catalyst and the third reforming catalyst are the same catalysts.

5. The process of claim 1 wherein the first reforming unit comprises two or more reactor beds with interheaters between the reactor beds.

6. The process of claim 1 further comprising passing the intermediate stream to a charge heater prior to passing the intermediate stream to the first reforming unit.

7. The process of claim 1 further comprising passing the first reforming effluent stream to a sulfur guard prior to passing the first reforming effluent stream to the second reforming unit.

8. The process of claim 1 wherein the first reforming unit and the third reforming unit use a first catalyst that is different from the second catalyst.

9. The process of claim 1 wherein the first catalyst is a dual function catalyst.

10. The process of claim 1 wherein the second catalyst is a single function catalyst.

11. The process of claim 1 wherein the second reforming unit comprises a fixed bed reactor.

12. The process of claim 1 wherein the first reforming unit and the third reforming unit comprise moving bed reactors.

13. The process of claim 12, wherein a first catalyst stream is passed to the first reforming unit and generates a first catalyst effluent stream, further comprising:

passing the first catalyst effluent stream to the third reforming unit to generate a second catalyst effluent stream.

14. A process for increasing the aromatics content in the process stream from a reforming reactor system comprising:

passing a hydrocarbon stream to a separation unit to generate a light stream comprising C5 and lighter hydrocarbons, an intermediate stream comprising C6 hydrocarbons and a heavy stream comprising C7+ hydrocarbons;

heating the intermediate stream and passing the intermediate stream to a first reforming unit, comprising a first catalyst, to generate a first reforming effluent stream;

heating the first reforming effluent stream and passing the first reforming effluent stream to a second reforming unit, comprising a second catalyst, to generate a second reforming effluent stream; and heating the second reforming effluent stream and the heavy stream and passing the second reforming effluent stream and the heavy stream to a third reforming unit, comprising the first catalyst, to generate a third effluent stream comprising C9 aromatic compounds.

15. The process of claim 14 wherein the first and third reforming unit comprise moving bed reactor systems.

16. The process of claim 15 further comprising:

passing the first catalyst in the first to the third reforming unit;

passing the catalyst in the third reforming unit to a regenerator; and passing catalyst from the regenerator to the first reforming unit.

17. The process of claim 14 further comprising:

passing the second catalyst from the second reforming unit to a second regenerator to generate a second regenerated catalyst stream; and passing the second regenerated catalyst stream to the second reforming unit.

18. The process of claim 14 wherein the first reforming unit comprises a plurality of reactor bed with interheaters between each pair of reactor beds.

19. The process of claim 14 wherein the second catalyst is a different catalyst from the first catalyst, and wherein the second catalyst has a higher rate of demethylation than the first catalyst.

20. The process of 14 wherein the first catalyst is a dual function catalyst.

* * * * *